US008176688B1

(12) United States Patent
Smith

(10) Patent No.: US 8,176,688 B1
(45) Date of Patent: May 15, 2012

(54) FLASHING ATTACHMENT APPARATUS

(76) Inventor: Walter J. Smith, Pensacola, FL (US)

( * ) Notice: Subject to any disclaimer, the term of this patent is extended or adjusted under 35 U.S.C. 154(b) by 170 days.

(21) Appl. No.: 12/799,880

(22) Filed: May 4, 2010

(51) Int. Cl.
*E04D 1/36* (2006.01)

(52) U.S. Cl. ..... 52/60; 52/58; 52/61; 52/62

(58) Field of Classification Search ..... 52/58, 60–62, 52/741.3, 741.4, 746.1
See application file for complete search history.

(56) References Cited

U.S. PATENT DOCUMENTS 1,699,181 A * 1/1929 Davison ..... 52/60
2,226,886 A * 12/1940 Willis ..... 52/62
2,984,049 A * 5/1961 Reddy ..... 52/60
3,090,161 A * 5/1963 Edwards ..... 52/60
3,277,618 A * 10/1966 Smith ..... 52/58
5,056,277 A * 10/1991 Wilson ..... 52/62
5,263,287 A * 11/1993 Lyons, Jr. ..... 52/58
5,927,023 A * 7/1999 Kittilstad ..... 52/60
6,108,981 A * 8/2000 Sama et al. ..... 52/60
6,167,660 B1 * 1/2001 Sama ..... 52/58
6,701,685 B2 * 3/2004 Rippey ..... 52/408
6,701,688 B2 * 3/2004 Matiere ..... 52/649.2
6,845,590 B1 * 1/2005 Mills, Jr. ..... 52/60
7,383,669 B2 * 6/2008 Morse ..... 52/545

* cited by examiner

*Primary Examiner* — William Gilbert
*Assistant Examiner* — Matthew Gitlin
(74) *Attorney, Agent, or Firm* — J. Nevin Shaffer, Jr.

(57) ABSTRACT

A flashing attachment apparatus and method includes an angle plate with a horizontal leg and a vertical leg wherein the horizontal leg includes a top and a back and wherein the vertical leg includes a front and a back. A bent plate is connected with the back of the vertical leg and a self adhering membrane is connected between the bent plate and the vertical leg to the back of the vertical leg wherein the self adhering membrane includes a removable cover shielding adhesive on the self adhering membrane.

18 Claims, 4 Drawing Sheets

FLASHING ATTACHMENT APPARATUS

FIELD OF THE INVENTION

This invention relates to a flashing attachment apparatus and method. In particular, in accordance with one embodiment, the invention relates, to a flashing attachment apparatus including an angle plate with a horizontal leg and a vertical leg wherein the horizontal leg includes a top and a back and wherein the vertical leg includes a front and a back. A bent plate is connected with the back of the vertical leg and a self adhering membrane is connected between the bent plate and the vertical leg to the back of the vertical leg wherein the self adhering membrane includes a removable cover shielding adhesive on the self adhering membrane.

BACKGROUND OF THE INVENTION

A serious problem exists in attempts to prevent water penetration into structures. In fact, as long as there have been structures, there has been a search for water prevention devices of all types. By way of example only and not by limitation, thru-wall flashings are used in buildings to prevent water penetrating through the interior wall of a cavity wall system. In concrete masonry unit (CMU) construction these flashings are installed at door heads, window heads and sills, and at the base of cavity walls. Flashing is also installed at floor lines in multi-story buildings and in curtain wall and storefront glazing systems.

For many years flashing materials were made from semi-rigid metal sheets, such as copper, galvanized steel, and aluminum. The metal flashings were installed in the CMU joints as coursing reached the point where they had to be installed to assure proper anchorage. The distance varies, but is usually sixteen inches above a finished floor line and eight inches above a door or window head. This approach left the exposed metal flashing material hanging down the face of the CMU and subject to physical damage and weather for long periods of time. Also, the vertical or lapped joints between sections of flashing had to be soldered or joined in some permanent, waterproof method, typically by a metal worker. While this system helped solve the problem of holding the flashing in place, this system added significant cost because it involved expensive materials that could be damaged easily, were difficult to replace properly, and required two different laborers to complete the work.

As a variety of plastics and rubber-based materials became available for flashings they were quickly substituted for the metal flashings to reduce costs. But the installation sequence remained unchanged so the materials were still hanging down the face of the wall subjecting the membrane to weather and physical damage and resulting in the flashing falling away from or totally off the structure until the veneer was applied.

Recently a system of self-adhering membranes and metal termination bars has become a popular flashing system. The self-adhering membrane is the primary flashing material and has one surface consisting of an adhesive that is temporarily protected by a paper coating. The coating is removed to expose the adhesive when installation begins. This material is commonly referred to as a "peel and stick" membrane. The membrane thickness varies but is generally in the forty mil range. The membrane is usually manufactured in rolls so that specific widths can be cut from the roll as wall height and cavity width conditions require.

With the self-adhering membrane, the flashing can be installed just before the outer veneer is to be applied which eliminates weather damage and significantly reduces physical damage prevalent in prior art systems. At the time of installation, a portion of the paper coating is removed and the top edge of the membrane is secured to the CMU wall by pressing the adhesive surface against the CMU. This membrane is fully adhered to the face of the wall starting, typically, a minimum of sixteen inches above the floor line (eight inches at a window or door head) and extending downward at least eight inches (one block). The remaining membrane section is loosely hung and curved away from the inner wall where it is terminated on top of the outer veneer at the outside edge.

The membrane adhesive alone, however, is not considered an adequate or long-term solution for holding the membrane to the wall. The membrane is subject to peeling back from the top and falling away from the CMU. Thus, installation of a termination bar at the top edge of the membrane is still required to provide long-term attachment. The termination bar is commonly fabricated in eight to ten foot long pieces of stainless steel or aluminum of varying thicknesses. Screws, made of similar materials, are installed in predrilled holes spaced anywhere from two to twelve inches on center along the centerline of the termination bar. To secure the bar it is necessary to either drill holes into the CMU using the predrilled holes in the bar as a guide, or use a power actuated fastener shot into the CMU through the holes. Once the bar is installed, a continuous bead of sealant is often applied along the top edge and at the drilled holes. This is done to prevent water that may penetrate the wall cavity from collecting on top of the bar and at the holes and eventually working through the mortar joint to the interior.

While the current membrane and termination bar system reduces potential damage to the flashing and does an adequate job of holding the flashing in place, it does not significantly reduce the cost of labor. And there is no certainty that the screws or other fasteners, and the sealant have been properly or completely installed. Once the veneer is applied and the wall cavity is enclosed it is impossible to detect and repair the source of the leak or reattach the membrane without removing the veneer.

What is required is a flashing attachment apparatus and method that is inexpensive, easy to use and that creates no new entries for water while ensuring that the flashing is held in place. It, therefore, is an object of this invention to provide a flashing attachment apparatus and method that requires no drilling, that once installed is held in place without screws or additional securing devices, that creates a stable termination bar that provides an overlapping attachment with flashing, and that is inexpensive to manufacture and easy to install.

SUMMARY OF THE INVENTION

Accordingly, the flashing attachment apparatus of the present invention, according to one embodiment includes an angle plate with a horizontal leg and a vertical leg wherein the horizontal leg includes a top and a back and wherein the vertical leg includes a front and a back. A bent plate is connected with the back of the vertical leg and a self adhering membrane is connected between the bent plate and the vertical leg to the back of the vertical leg wherein the self adhering membrane includes a removable cover shielding adhesive on the self adhering membrane.

As used herein, terms are given their common meaning as known in the art. Thus, "angle plate" describes a device, preferably made of metal but which may be made of any suitable material such as plastic or any other material now known or hereafter developed. The "angle plate" as is described more fully herein, is formed, typically, from a single, flat piece of material that is bent between the edges along its length to form, typically, an "L" shaped device in which both legs are of about the same approximate width. When the length of the angle plate is held horizontally, the two legs form a horizontal leg and a vertical leg.

Further, as used herein, the term "membrane" includes material that is more flexible than the angle plate, for example, although the membrane may be composed of the same material but thinner in dimension. Preferably, the membrane is a flexible material such as a flexible plastic or rubber of some suitable and useful type.

Further, the term "self-adhering" is used commonly to describe a material that preferably includes adhesive on at least some part of the material and may be connected by the adhesive to another surface without need of adding adhesive material. The term also includes material that becomes self adhering due to the use of heat or chemicals, for example only and not by limitation.

In another aspect of the invention, the angle plate includes at least one slot completely through the horizontal leg from the top to the back of the horizontal leg. In one aspect, the bent plate is connected directly to the back of the vertical leg along a first portion of the bent plate and wherein along a second portion of the bent plate the bent plate is spaced apart from the back of the vertical leg. In a further aspect, the second portion creates a mortar space above the second portion, underneath the back of the horizontal leg and adjacent the back of the vertical leg, and a membrane space between the second portion and the back of the vertical leg.

In one aspect, the first portion includes a number of connection welds connecting the first portion to the vertical leg. In another aspect, the membrane is connected to the second portion by at least one serrated hole punched through the second portion and into the membrane. In a further aspect, the second portion includes a lower edge and the vertical leg includes a lower edge and the lower edges are approximately parallel to each other. In another aspect, the membrane extends below the lower edges. In yet another aspect, the membrane is a flexible, peel and stick membrane and includes a perforation in the removable cover such that the removable cover is detachable from the flexible membrane along the perforation and below the lower edges.

According to another embodiment of the invention, a flashing attachment apparatus includes an angle plate with a horizontal leg and a vertical leg wherein the horizontal leg includes a top and a back and wherein the vertical leg includes a front and a back and wherein the angle plate includes at least one slot completely through the horizontal leg from the top to the back of the horizontal leg. A bent plate is connected with the back of the vertical leg wherein the bent plate is connected directly to the back of the vertical leg along a first portion of the bent plate and wherein along a second portion of the bent plate the bent plate is spaced apart from the back of the vertical leg and wherein the second portion creates a mortar space above the second portion, underneath the back of the horizontal leg and adjacent the back of the vertical leg, and a membrane space between the second portion and the back of the vertical leg. A flexible, peel and stick membrane is connected between the bent plate and the vertical leg to the back of the vertical leg wherein the flexible, peel and stick membrane includes a removable cover shielding adhesive on the flexible, peel and stick membrane and wherein the membrane includes a perforation in the removable cover such that the removable cover is detachable from the flexible, peel and stick membrane along the perforation.

In another aspect of this invention, the first portion includes a number of connection welds connecting the first portion to the vertical leg. In one aspect, the membrane is connected to the second portion by at least one serrated hole punched through the second portion and into the membrane. In a further aspect, the second portion includes a lower edge and the vertical leg includes a lower edge and the lower edges are approximately parallel to each other. In one aspect, the flexible, peel and stick membrane extends below the lower edges.

According to another embodiment of the invention, a method for attaching flashing includes the steps of:

a. providing an angle plate with a horizontal leg and a vertical leg wherein the horizontal leg includes a top and a back and wherein the vertical leg includes a front and a back; a bent plate connected with the back of the vertical leg; and a self adhering membrane connected between the bent plate and the vertical leg to the back of the vertical leg wherein the self adhering membrane includes a removable cover shielding adhesive on the self adhering membrane; and b. placing the horizontal leg on top of a structure with a top and an outer face wherein the outer face is covered with a flashing such that the self adhering membrane overlaps the flashing; and c. connecting the self adhering membrane with the flashing.

In another aspect of this invention, the angle plate includes at least one slot completely through the horizontal leg from the top to the back of the horizontal leg such that mortar on the top of the structure passes through the at least one slot. In one aspect, the bent plate is connected directly to the back of the vertical leg along a first portion of the bent plate and wherein along a second portion of the bent plate the bent plate is spaced apart from the back of the vertical leg such that the second portion creates a mortar space above the second portion, underneath the back of the horizontal leg and adjacent the back of the vertical leg, and a membrane space between the second portion and the back of the vertical leg.

In a further aspect, the second portion includes a lower edge and the vertical leg includes a lower edge and the lower edges are approximately parallel to each other and the self adhering membrane extends below the lower edges.

In another aspect, the membrane is a flexible, peel and stick membrane and includes a perforation in the removable cover such that the removable cover is detachable from the flexible membrane along the perforation and below the lower edges and further includes the steps of:

a. removing the removable cover along the perforation; and b. connecting the adhesive on the flexible membrane with the flashing.

In another aspect, the method further includes the steps of a. providing a number of angle plates; and b. overlapping the angle plates such that the entire top of a structure is covered by angle plates in overlapping relation.

DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE INVENTION

Figure 1:
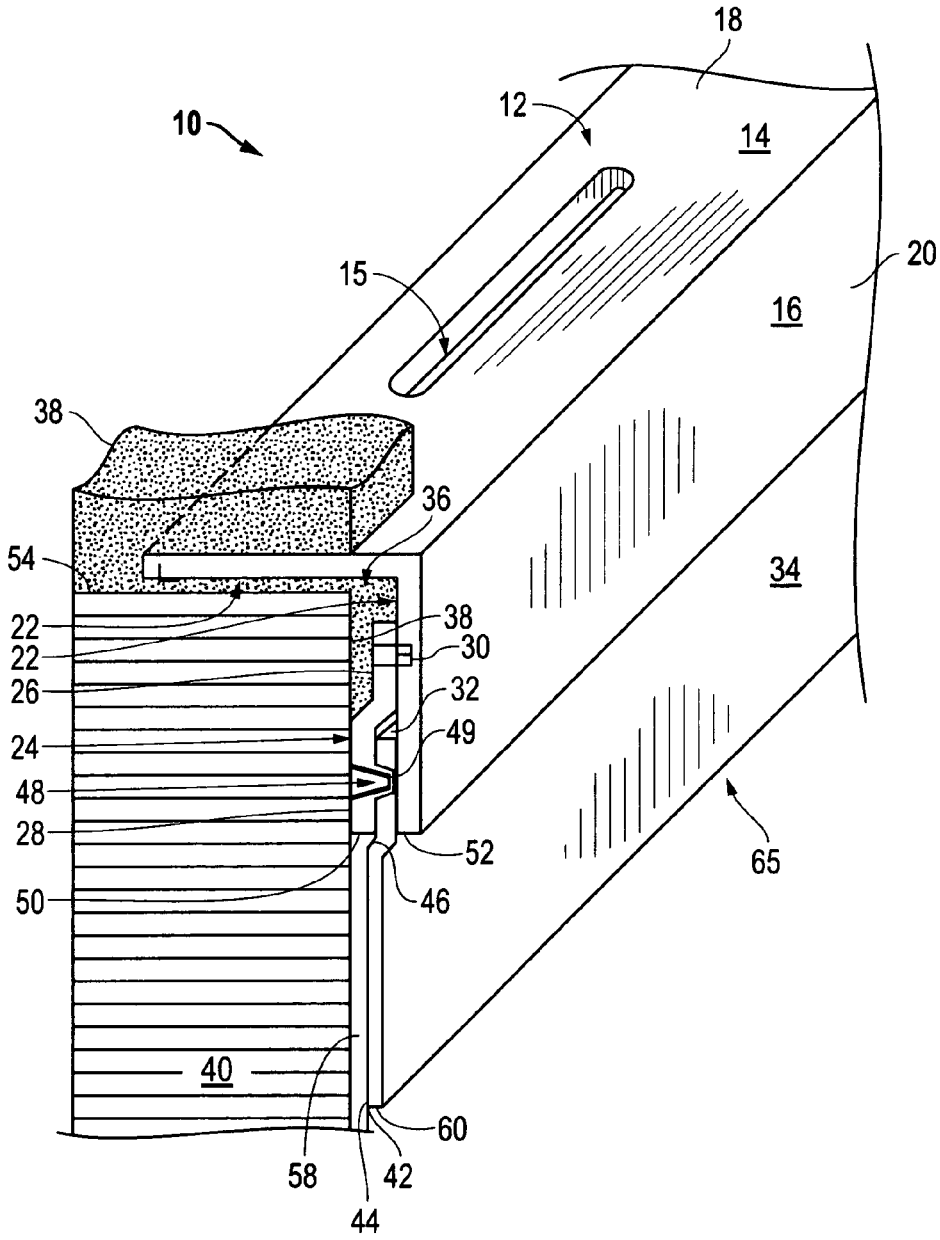
FIG. 1 is an isometric view of the flashing attachment apparatus according to one embodiment.

The preferred embodiment of the present invention is illustrated by way of example in FIGS. 1-6. With specific reference to FIGS. 1 and 2, flashing attachment apparatus 10, according to a preferred embodiment, includes an angle plate 12. Angle plate 12 includes a horizontal leg 14 and a vertical leg 16. Horizontal leg 14 includes an outer surface or top 18 and vertical leg 16 includes an outer surface or front 20. Both horizontal leg 16 and vertical leg 18 include an inner surface or back 22.

Again, angle plate 12 is preferably formed from a single piece of material, preferably metal such as for example only stainless steel or aluminum, bent along its length to form two parts, horizontal leg 14 and vertical leg 16. Obviously, the angle plate 12 may be formed by welding or connecting by some other suitable means two separate legs. As illustrated, horizontal leg 14 is connected with vertical leg 16 nearly perpendicularly. Certainly, the angle of connection may be more than or less than ninety degrees according to the needs of a particular situation. Likewise, angle plate 12 may be reversed such that vertical leg 16 faces up from horizontal leg 14 and not down as illustrated. Further, angle plate 12 may be positioned vertically on a structure, such as lengthwise on a corner of a structure, and not horizontally, such that the legs extend to either side of the corner, for example only and not by way of limitation.

A bent plate 24 is connected to the back 22 of vertical leg 16 as illustrated. Preferably, bent plate 24 includes a first portion 26 and a second portion 28. Preferably, first portion 26 is connected to the back 22 of vertical leg 16 by spot welds 30 or any other connection device now known or hereafter developed.

Second portion 28 of bent plate 24 is bent such that it is spaced apart from the back 22 of vertical leg 16. This feature of the present invention is important in that it accomplishes several required elements of the invention. First, it creates a membrane space 32 into which membrane 34 is inserted and retained, as will be described more fully hereafter. Secondly, it creates a mortar space 36 above the second portion 28. That is, mortar space 36 is created underneath the back 22 of horizontal leg 14 and adjacent the back 22 of the vertical leg 16 as illustrated. Mortar space 36 creates a space for mortar 38 to collect when flashing attachment apparatus 10 is installed as will be more fully described hereafter. Applicant has determined, however, that this mortar space 36 significantly and unexpectedly increases the strength of the connection of the flashing attachment apparatus 10 with a structure 40, again as will be more fully described hereafter.

Additionally, preferably, angle plate 12 includes a slot 15 that passes completely through the top 18 to the back 22 of horizontal leg 14. The provision of slot 15 allows mortar 38 to pass through the slot 15 and greatly enhances the ability of mortar to hold angle plate 12 in place as will be more fully described hereafter.

Membrane 34 is preferably a self-adhesive material as discussed above. Preferably, membrane 34 is a "peel and stick" membrane with an adhesive 42 on at least one side. Preferably, adhesive 42 is temporarily protected by a removable cover 44. In a preferred embodiment removable cover 44 includes a knife cut or perforation 46 at a desired location to assist in the detachment of removable cover 44 from some or all of membrane 34 when desired.

According to a preferred embodiment, membrane 34 is held in place in membrane space 32 by connection with second portion 28. Applicant has found that a suitable connection is obtained by punching a hole 48 through second portion 28 into membrane 34 after membrane 34 is located in membrane space 32. The punched hole 48 creates splayed or serrated edges 49 that expand to grip membrane 34 securely in place without fear membrane 34 will drop out of membrane space 32 in use. Certainly, any other suitable device for connecting membrane 34 in membrane space 32, such as glue or epoxy, for example only and not by way of limitation, that may be suitable for the purposes of the invention is included.

In a preferred embodiment, after connection of the first portion 26 to the back 22 of vertical leg 16, the lower edge 50 of second portion 28 generally aligns with and is approximately parallel to the lower edge 52 of vertical leg 16 as illustrated. Preferably, membrane 34 extends some distance below the lower edges 50 and 52 such that a long section of overlapping membrane 34 below the lower edges 50 and 52 is provided.

Figure 2:
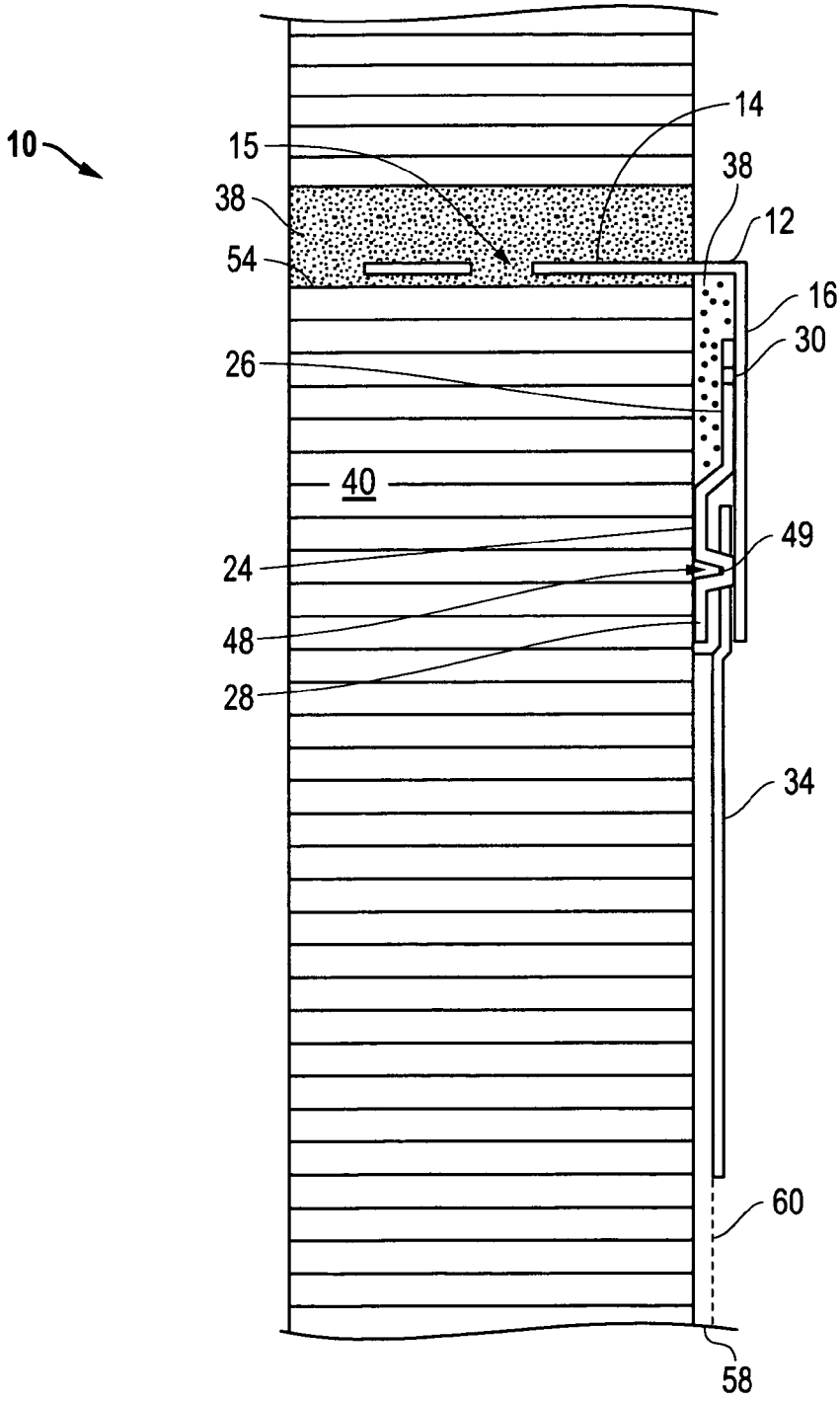
FIG. 2 is a side section view of the invention of FIG. 1.

Still referring to FIGS. 1 and 2, the installation of flashing attachment 10 is illustrated in a typical situation where the horizontal leg 14 of angle plate 12 is placed on the top 54 of a particular part of structure 40. Top 54 includes a mortar joint 56 and mortar 38. As illustrated, applicant's flashing attachment apparatus 10 is positioned such that horizontal leg 14 is completely covered by mortar 38. This ensures that flashing attachment is securely connected with structure 40 without the need to drill holes, as in the prior art. Further, applicant has determined that the provision of through slot 15 enables mortar 38 to create a solid link from the top 14 to the back 22 of horizontal leg 14 to the structure 40 which has been found to greatly increase the stability of the connection, all again without need to drill or add screws.

Once horizontal leg 14 is in place, the membrane 34 is conformed to overlap the underlying flashing 58 on the outside 60 of flashing 58. This creates a covering, overlap and effectively prevents the passage of moisture passed membrane 34. Thereafter, removable cover 44 is removed from membrane 34 which exposes adhesive 42. Preferably, perforation 46 provides an easy to use, predetermined place for removal such that the portion of the membrane 34 below the lower edge 52 of vertical leg 16 has exposed adhesive 42. Certainly, removable cover 44 may be removed before horizontal leg 14 is placed in position as described above.

Once horizontal leg 14 is in proper position and the removable cover 44 is removed, final installation of the flashing attachment apparatus requires the connection of the adhesive 42 and thus membrane 34 with the flashing 58. Connection simply requires pressing membrane 34 against flashing 58 so as to seal the two membranes together.

Figure 3:
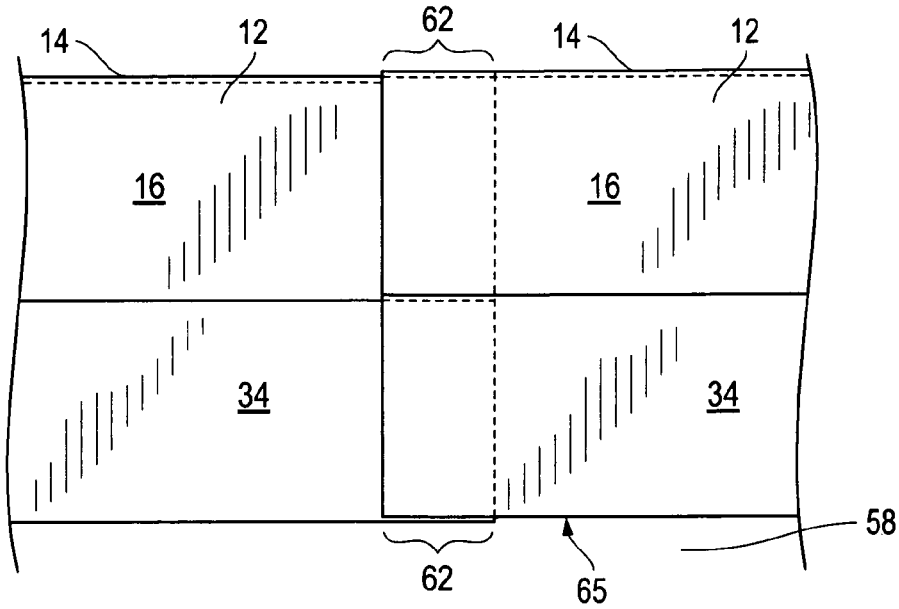
FIG. 3 is a front view of the invention of FIGS. 1 and 2 showing an overlapping combination of flashing attachments.

Referring now to FIG. 3, it is shown that a preferred embodiment of flashing attachment 10 includes connecting sections of angle plate 12 by creating an overlap 62. The overlap 62 may be as much or as little as required by the particular situation and provides the advantage of enabling complete coverage of the top 54 of a structure 40 without need to cut or re-cut angle plates 12. Once in position, flashing attachment apparatus 10 is held in position as described above by mortar 38 and by connection of membrane 34 to flashing 58. Further membranes 34 include the same overlap 62 and in the overlap 62 one of the membranes 34 is adhered to the other membrane 34 which is in contact with flashing 58. Adhesive 42 ensures that no moisture will penetrate the vertical seam created by the overlap 62.

Figure 4:
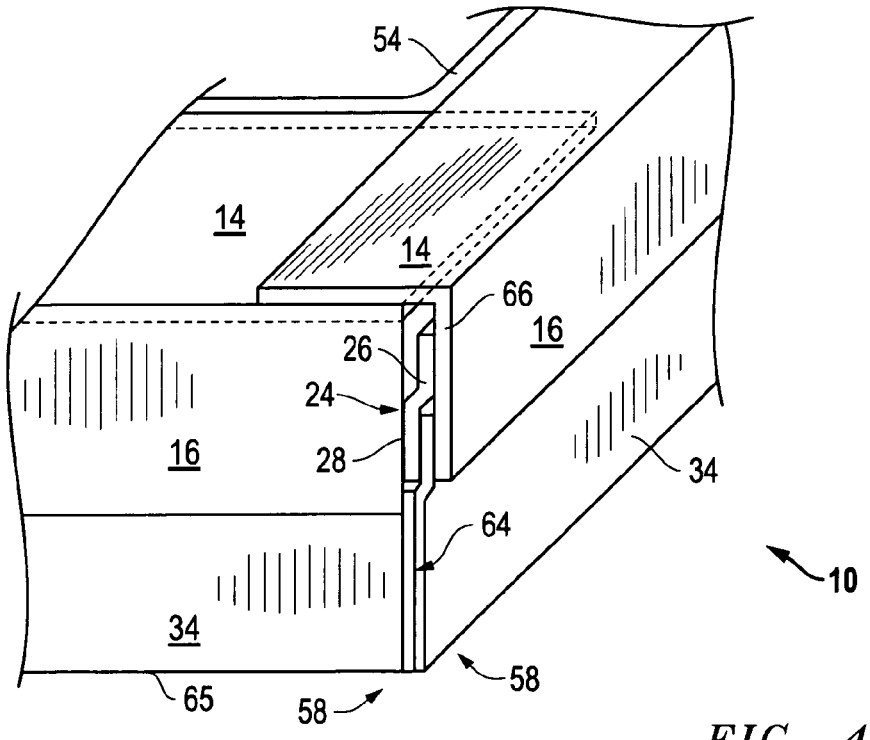
FIG. 4 is an isometric view of the invention of FIGS. 1 and 2 showing an overlapping combination at a corner of a structure.
Figure 5:
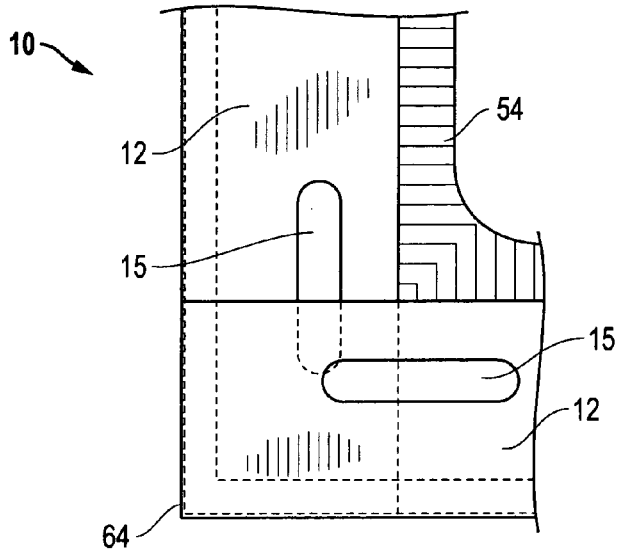
FIG. 5 is a top view of the invention of FIG. 4.

Referring now to FIGS. 4 and 5, it is illustrated how applicant's flashing attachment apparatus 10 is used to cover corners. As illustrated, in this instance, one angle plate 12 overlaps another angle plate 12 as described with reference to FIG. 3 but in this instance the angle plates 12 are overlapped at an angle to each other. As illustrated, the two angle plates are overlapped at approximately ninety-degrees to each other. Obviously, any angle is easily accommodated by the invention. It should be understood that the flashing 58 covers the corner and membranes 34 create a vertical line 64 at the corner where the two angle plates overlap. Because membranes 34 are sealed by adhesive 42 to flashing 58 and because flashing 58 covers the corner underneath vertical line 64 a complete moisture barrier is created. FIG. 5 shows a top view of a corner connection as just described. Certainly, it should be understood that membrane 34 may be conformed to extend beyond the end 66 of angle plate 12 so as to provide some membrane 34 to cover vertical line 64 if desired.

Figure 6:
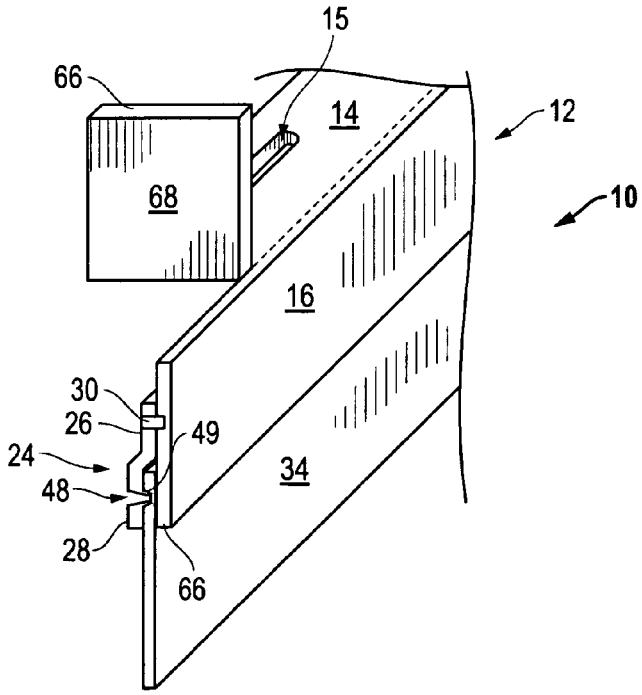
FIG. 6 is an isometric view of the invention of FIGS. 1 and 2 showing a portion of the horizontal leg bent to form an end dam.

Referring now to FIG. 6 it is illustrated how flashing attachment apparatus 10 may be easily modified to create an end dam 68. The user uses metal shears to cut a portion of horizontal leg 14 away from vertical leg 16. The cut portion is then moved to create the end dam 68. The movement is a simple bending movement and requires no special tools to accomplish. Importantly, no damage is done to the other elements of the invention, the vertical leg 16, bent plate 24 and/or membrane 34. Thus, applicant has found that in situ modification of flashing attachment apparatus 10 is simple and easy to accomplish, requires no special tools and greatly increases the overall capabilities of the invention.

By way of further explanation, the thru-wall flashing 58, a peel and stick membrane typically, that is adhered directly to the wall surface and is the primary waterproofing component for the structure 40. Applicant's flashing attachment apparatus and method 10, among other things, replaces the termination bar component currently used in wall flashing systems. Applicant's invention provides the security required at the top of the thru-wall flashing 58 and additional protection from water penetration because there is no continuous joint at the top of the flashing 58 as there is with the termination bar system. Because the invention is set flush against the wall at the mortar joint 56 and the edge is a smooth, curved transition, no water will be able to accumulate and penetrate the structure 40. The vertical joints 64 at the overlaps 62 and in the internal corners do not need to be sealed with such precision because the small amount of water that may enter the joints will be below a mortar joint 56 and thus protected by underlying flashing 58.

The applicant's flashing attachment apparatus and method 10 is usable with any of the flexible, self-adhering membranes presently manufactured and eliminates the screw-applied termination bar and sealant as required currently. The flashing attachment apparatus and method 10 consists of three major components: an angle plate 12, a self-adhering flexible membrane 34 with a removable paper backing or cover 44, and a bent plate 24.

Angle Plate 12 Description: The angle plate 12 is preferably a one and one-half inch by one and one-half inch twenty-gauge galvanized steel metal angle that is eight feet long (stainless steel may be substituted) with slots 30 in one face, horizontal leg 14. The angle plate 12 is oriented with the slotted face horizontal and set into a standard mortar joint 56 as described above. The top surface of the horizontal leg 14 is pierced with slots 15 that, according to a preferred embodiment, are one-quarter inch wide by one and one-quarter inch long spaced at two inches on center. A one-eighth inch radius may be applied at the corners depending upon the manufacturing tool used to make the slots 15. The edge of the first slot 15 is preferably located one inch from the end 66. The slots 15 allow for the angle plate 14 to be securely embedded in the mortar joint 56 as described above. (See FIGS. 1 and 2)

Membrane 34 Description: The flexible membrane 34 is a self-adhering material commonly referred to as a "peel and stick" membrane typically used for flashing. The membrane 34 is preferably eight feet long, to match the length of the angle plate 12, and is referred to as a "peel and stick" membrane typically used for flashing. The eight foot long membrane 34 is sandwiched between the angle plate 12 and the bent plate 24 and preferably extends a minimum of two inches below the lower edges 50 and 52 of the angle plate 12. A knife cut or perforation 46, preferably along the lower edges 50 and 52 of the bent plate 12, is provided in one embodiment in the paper backing, removable cover 44, only so that the paper can be removed easily at a later time. All of the protective paper coating that is provided by the membrane manufacturer remains in place.

The top one-half inch of the membrane 34 is secured, in a preferred embodiment, to the lower section of the bent plate 24 by conical, serrated, holes 48 punched at two inches on center with the first punch one-half inch from the end 66 of the angle plate 12. The cone and serrations, edges 49, of holes 48 prevent the membrane 34 from sliding off of or becoming detached from the bent plate 24. Again preferably, the membrane 34 is extended from the bottom, lower edge 52 of the vertical leg 16 of the angle plate 12 by a minimum of two inches to allow sufficient surface area to secure the membrane 34 to the final section of thru-wall flashing 58. (See FIGS. 1, 2, 4 and 6)

Bent Plate 24 Description: The bent plate 24 preferably is a one and one-eighth inch by twenty gauge plate, also eight feet long, made of the same material as the angle plate 12, bent slightly along the center axis to the thickness of the membrane material 34. (See FIGS. 1, 2, 4 and 6) The bent plate 24 with the membrane 24 attached is then secured to the back side 22 of the vertical leg 16 of the angle plate 12 with spot welds 30 starting at one-half inch from the end 66 and spaced at two inches on center from that point. The bottom edge, lower edge 50 of the bent plate 24 is preferably located flush with the bottom edge, lower edge 52, of the vertical leg 16 of the angle plate 12. The second portion 28 of bent plate 24 thus creates a mortar space 36 of approximately one-quarter of an inch between the top of the bent plate 24 and the underside, back 22, of the horizontal leg 14 of the angle plate 12 as described above. The mortar space 36 allows for excess mortar 38 in the mortar joint 56 to accumulate behind the angle plate 12 greatly increasing the stability of the flashing attachment apparatus 10. (See FIGS. 1 and 2)

In use, again, the flashing attachment apparatus 10 is laid by the mason at the outside face of the CMU in the normal block mortar joint, then pushed against the outside face 60 of the masonry structure 40, for example only, and left exposed until the veneer is installed. At that time, membrane 34 is lifted up and the upper edge of the final thru-wall flashing 58 material (a compatible "peel and stick" membrane) is stripped of its protective paper backing and adhered to the masonry wall if not already attached, as is current practice. The exposed two inches of the paper backing, the removable cover 44, of the membrane 34 is then removed and the adhesive face is pushed flush against the outside face of the final thru-wall flashing membrane 58 continuously along the wall. The resulting horizontal joint 65 (see FIGS. 13, and 4) in the two membranes overlaps in the direction of potential water flows so no additional sealant or soldering or other attachment is required at the horizontal joint. (See FIGS. 1, 2, and 3)

Further, the horizontal joints 65 that occur along the wall are overlapped by a minimum of three-quarters of an inch with the individual exposed membranes, 34 and 58, adhered to each other. Any water that might migrate horizontally through the open end of the overlapping devices to the end of the one that is on the bottom will be minor. The protective paper can remain in place until the final thru-wall flashing 58 is installed. The overlapping section of membrane 34 can be adhered to the adjacent device at that time.

Forming External Corners: External and internal corners of any angle can be formed from the basic flashing attachment apparatus 10. The horizontal legs 14 of two devices are simply overlapped at the corner. The horizontal joint at the top of the external corner devices will be buried in the mortar joint 56. The vertical joint 64 of the external corner devices is at the end of a device similar to a horizontal joint 65 lap. The final thru-wall flashing 58 is wrapped slightly around the corner to avoid creating an open vertical joint 64. Importantly, the protective paper, removable cover 44, on the apparatus must remain in place until the final thru-wall flashing 58 is installed.

Forming Internal Corners: For an internal corner the ends 66 of a pair of flashing attachment apparatus 10 are terminated in the corner. Overlapping is not required. The void between the ends 66 of the horizontal legs 14 of both devices will be filled with mortar 38. The final thru-wall flashing 58 is wrapped slightly around the corner to avoid creating an open vertical joint 64. Again, for best results, the protective paper, removable cover 44, on the apparatus 10 must remain in place until the final thru-wall flashing 58 is installed.

Some trim of the top horizontal leg 14 may be necessary if the angle of the wall is greater than ninety degrees, but typical cavity dimensions should permit the flashing attachment apparatus 10 to be installed without trimming it. Still further, curved sections may be developed by making a series of straight or vee-shaped cuts in the horizontal leg 14 at intervals that will allow the bend to develop.

Among many advantages over the prior art, applicant has determined that the only tool required to completely install the flashing attachment apparatus 10 of the present invention is a standard sheet metal cutter, and all work can be performed by masons as the wall is constructed. The invention, further, may also be used in cavity wall systems where deep concrete beams are used to span openings. Still further, scrap pieces of the device can be salvaged for use in other projects.

As described herein, it should be understood that angle plate 12 and bent plate 24 could be constructed from a single piece of material. That is, starting with the lower edge 52 of angle plate 12, a single piece of material would extend upward to form the vertical leg 16 then horizontally to form the horizontal leg 14. From there it would fold under itself and run horizontally under horizontal leg 14 and then extend down to form bent plate 24 and end at lower edge 50. While two separate pieces, angle plate 12 and bent plate 24, may be desired, again, a single piece of material formed to create the required structure, including the membrane space 32, would suffice.

The description of the present embodiments of the invention has been presented for purposes of illustration, but is not intended to be exhaustive or to limit the invention to the form disclosed. Many modifications and variations will be apparent to those of ordinary skill in the art. As such, while the present invention has been disclosed in connection with an embodiment thereof, it should be understood that other embodiments may fall within the spirit and scope of the invention as defined by the following claims.

What is claimed is:

1. A flashing attachment apparatus comprising:

a. an angle plate with a horizontal leg and a vertical leg wherein said horizontal leg includes a top and a back and wherein said vertical leg includes a front and a back;

b. a bent plate connected with the back of the vertical leg wherein said bent plate is connected directly to the back of said vertical leg along a first portion of said bent plate and wherein along a second portion of said bent plate said bent plate is spaced apart from said back of said vertical leg; and c. a self adhering membrane connected between said bent plate and said vertical leg to the back of said vertical leg wherein said self adhering membrane includes a removable cover shielding adhesive on said self adhering membrane and wherein said membrane is connected to said second portion by at least one serrated hole punched through said second portion and into said membrane.

2. The apparatus of claim 1 wherein said angle plate includes at least one slot completely through the horizontal leg from the top to the back of said horizontal leg.

3. The apparatus of claim 1 wherein said second portion creates a mortar space above said second portion, underneath the back of said horizontal leg and adjacent the back of said vertical leg, and a membrane space between said second portion and said back of said vertical leg.

4. The apparatus of claim 1 wherein said first portion includes a plurality of connection welds connecting said first portion to said vertical leg.

5. The apparatus of claim 1 wherein said second portion includes a lower edge and said vertical leg includes a lower edge and wherein said lower edges are approximately parallel to each other.

6. The apparatus of claim 5 wherein said membrane extends below said lower edges.

7. The apparatus of claim 5 wherein said membrane is a flexible, peel and stick membrane and includes a perforation in said removable cover such that the removable cover is detachable from said flexible membrane along said perforation and below said lower edges.

8. A flashing attachment apparatus comprising:

a. an angle plate with a horizontal leg and a vertical leg wherein said horizontal leg includes a top and a back and wherein said vertical leg includes a front and a back and wherein said angle plate includes at least one slot completely through the horizontal leg from the top to the back of said horizontal leg;

b. a bent plate connected with the back of the vertical leg wherein said bent plate is connected directly to the back of said vertical leg along a first portion of said bent plate and wherein along a second portion of said bent plate the bent plate is spaced apart from said back of said vertical leg and wherein said second portion creates a mortar space above said second portion, underneath the back of said horizontal leg and adjacent the back of said vertical leg, and a membrane space between said second portion and said back of said vertical leg; and c. a flexible, peel and stick membrane connected between said bent plate and said vertical leg to the back of said vertical leg wherein said flexible, peel and stick membrane includes a removable cover shielding adhesive on said flexible, peel and stick membrane and wherein said membrane includes a perforation in said removable cover such that the removable cover is detachable from said flexible, peel and stick membrane along said perforation.

9. The apparatus of claim 8 wherein said first portion includes a plurality of connection welds connecting said first portion to said vertical leg.

10. The apparatus of claim 8 wherein said membrane is connected to said second portion by at least one serrated hole punched through said second portion and into said membrane.

11. The apparatus of claim 8 wherein said second portion includes a lower edge and said vertical leg includes a lower edge and wherein said lower edges are approximately parallel to each other.

12. The apparatus of claim 11 wherein said flexible, peel and stick membrane extends below said lower edges.

13. A flashing attachment apparatus comprising:

a. an angle plate with a horizontal leg and a vertical leg wherein said horizontal leg includes a top and a back and wherein said vertical leg includes a front and a back;

b. a bent plate connected with the back of the vertical leg wherein said bent plate is connected directly to the back of said vertical leg along a first portion of said bent plate and wherein along a second portion of said bent plate said bent plate is spaced apart from said back of said vertical leg wherein said second portion includes a lower edge and said vertical leg includes a lower edge and wherein said lower edges are approximately parallel to each other; and c. a self adhering membrane connected between said bent plate and said vertical leg to the back of said vertical leg wherein said self adhering membrane includes a removable cover shielding adhesive on said self adhering membrane wherein said membrane is a flexible, peel and stick membrane and includes a perforation in said removable cover such that the removable cover is detachable from said flexible membrane along said perforation and below said lower edges.

14. The apparatus of claim 13 wherein said angle plate includes at least one slot completely through the horizontal leg from the top to the back of said horizontal leg.

15. The apparatus of claim 13 wherein said second portion creates a mortar space above said second portion, underneath the back of said horizontal leg and adjacent the back of said vertical leg, and a membrane space between said second portion and said back of said vertical leg.

16. The apparatus of claim 13 wherein said first portion includes a plurality of connection welds connecting said first portion to said vertical leg.

17. The apparatus of claim 13 wherein said membrane is connected to said second portion by at least one serrated hole punched through said second portion and into said membrane.

18. The apparatus of claim 13 wherein said membrane extends below said lower edges.

* * * * *